US005458525A

United States Patent [19]

How

[11] Patent Number: 5,458,525

[45] Date of Patent: Oct. 17, 1995

[54] TOY HAVING A CONCEALABLE AND ELEVATIONAL HEAD

[76] Inventor: Chin-Jung How, 58, Ma Yuan West St., Taichung, Taiwan

[21] Appl. No.: 309,392

[22] Filed: Sep. 20, 1994

[51] Int. Cl.[6] ..... A63H 13/16

[52] U.S. Cl. ..... 446/310; 40/414

[58] Field of Search ..... 446/310, 175, 446/300, 320, 489, 298, 299; 40/414, 423, 429, 470, 491

[56] References Cited

U.S. PATENT DOCUMENTS

| | | | |
|---|---|---|---|
| 1,590,519 | 6/1926 | Jones | 446/310 |
| 1,789,095 | 1/1931 | Berger | 446/310 |
| 2,858,644 | 11/1958 | Derham | 446/310 |
| 5,088,373 | 2/1992 | Hou | 446/298 X |
| 5,331,110 | 7/1993 | Chen | 446/298 X |

*Primary Examiner*—Mickey Yu

[57] ABSTRACT

A toy includes a housing having a cap disposed on the upper portion, a sliding element disposed in the housing and slidable up and down, a head or a figure fixed to the sliding element and the cap and concealed in the housing, the figure and the cap can be moved outward of the housing by a gearing such that the figure can be seen from outside of the housing, a speaker utters a sound and one or more light bulbs are energized when the figure is moved out of said housing in order to frighten other people.

2 Claims, 6 Drawing Sheets

Z-Z

TOY HAVING A CONCEALABLE AND ELEVATIONAL HEAD

BACKGROUND OF THE INVENTION

1. Field of the Invention

The present invention relates to a toy, and more particularly to a toy having a concealable and elevational head.

2. Description of the Prior Art

Various kinds of figure toys have been developed and comprise a figure body, the heads thereof can not be concealed or elevated.

The present invention has arisen to mitigate and/or obviate the afore-described disadvantages of the conventional toys.

SUMMARY OF THE INVENTION

The primary objective of the present invention is to provide a toy which includes a head that can be concealed and elevated.

In accordance with one aspect of the invention, there is provided a toy comprising a housing including an upper portion having a cap provided thereon and including a hollow interior having a bottom portion, a base secured in the bottom portion, a figure secured to the cap and concealed in the housing, and means for elevating the figure and the cap in order to move the figure out of the housing.

The elevating means includes a gear box disposed on the base, an axle rotatably supported in the gear box and extended outward of the gear box, a lever including a first end fixed to the axle and a second end having a stub secured thereto, means for rotating the axle, a plate fixed to the gear box and including a projection extended toward the gear box, a sliding element slidingly disposed between the plate and the gear box and including a vertical groove and a transverse groove formed therein for engaging with the projection and the stub respectively, the figure is fixed to the sliding element, the sliding element is limited to move up and down by engagement between the projection and the vertical groove, and the sliding element is moved up and down by engagement between the stub and the transverse groove when the lever is rotated.

The rotating means includes a motor disposed in the gear box and including a spindle, and a gearing engaged between the spindle and the axle so as to transmit a rotational movement of the spindle to the axle, whereby, the axle is rotated by the motor when the motor is energized.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
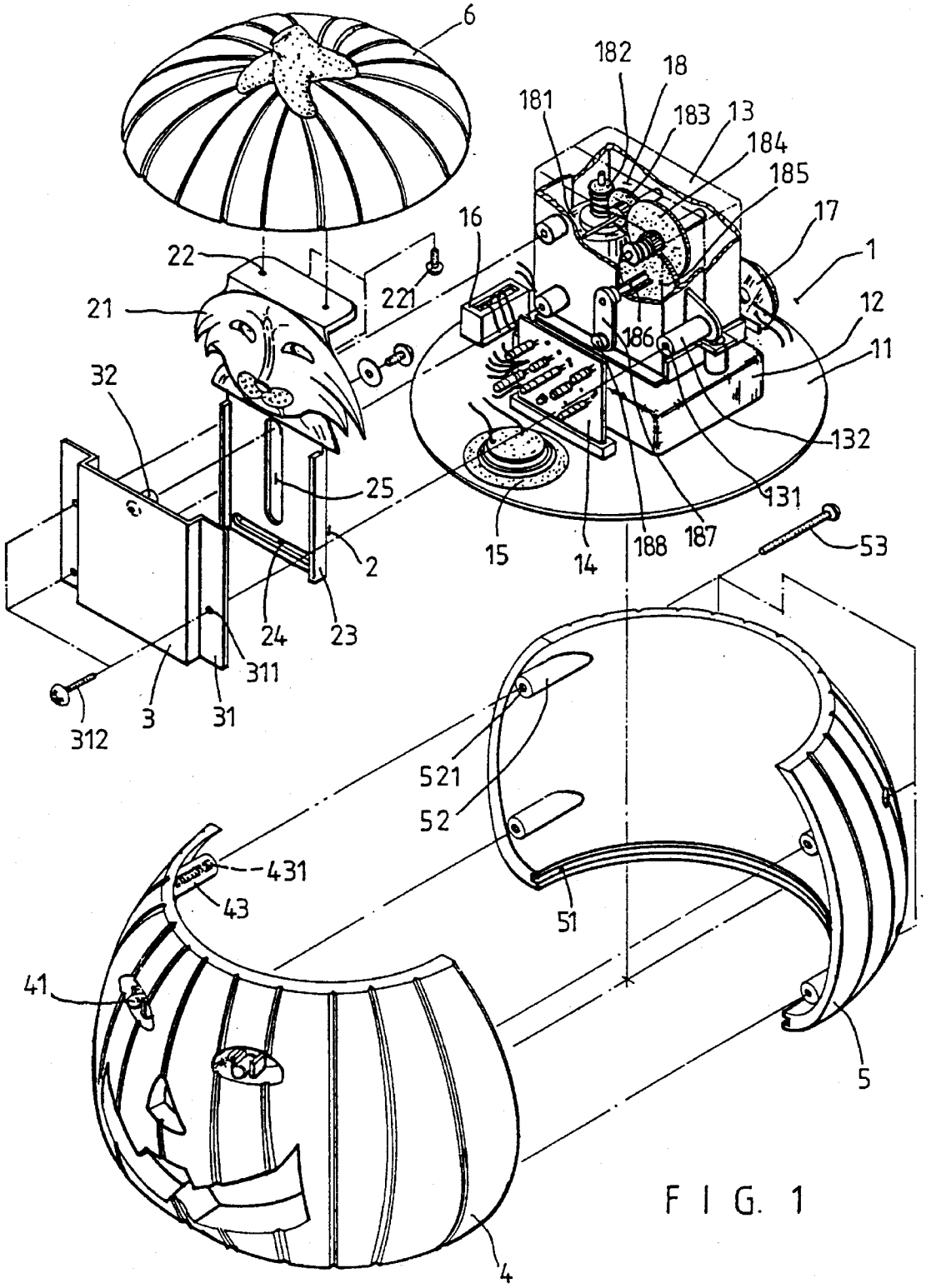
FIG. 1 is an exploded view of a toy in accordance with the present invention.
Figure 2:
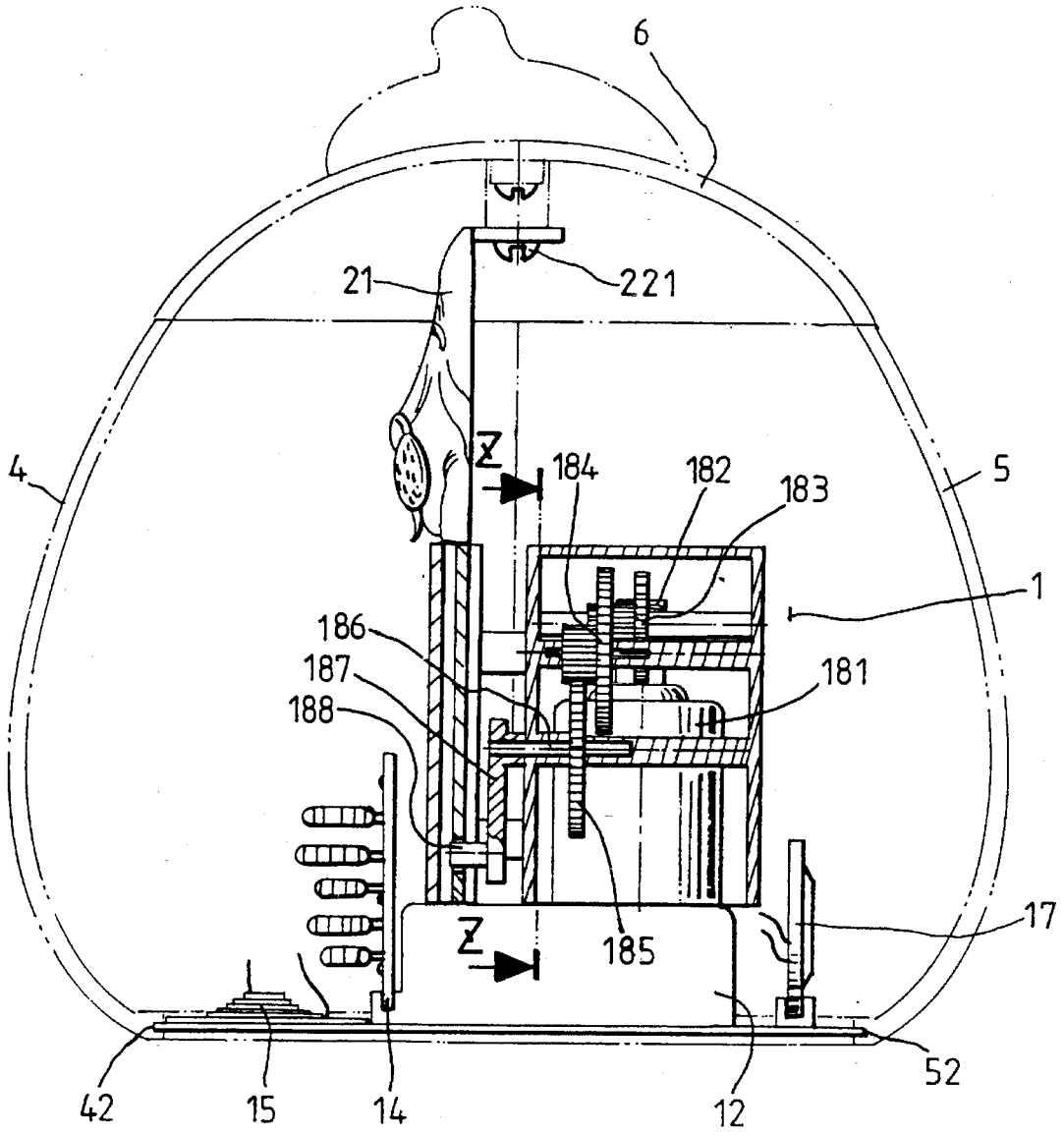
FIG. 2 is a cross sectional view of the toy.
Figure 3:
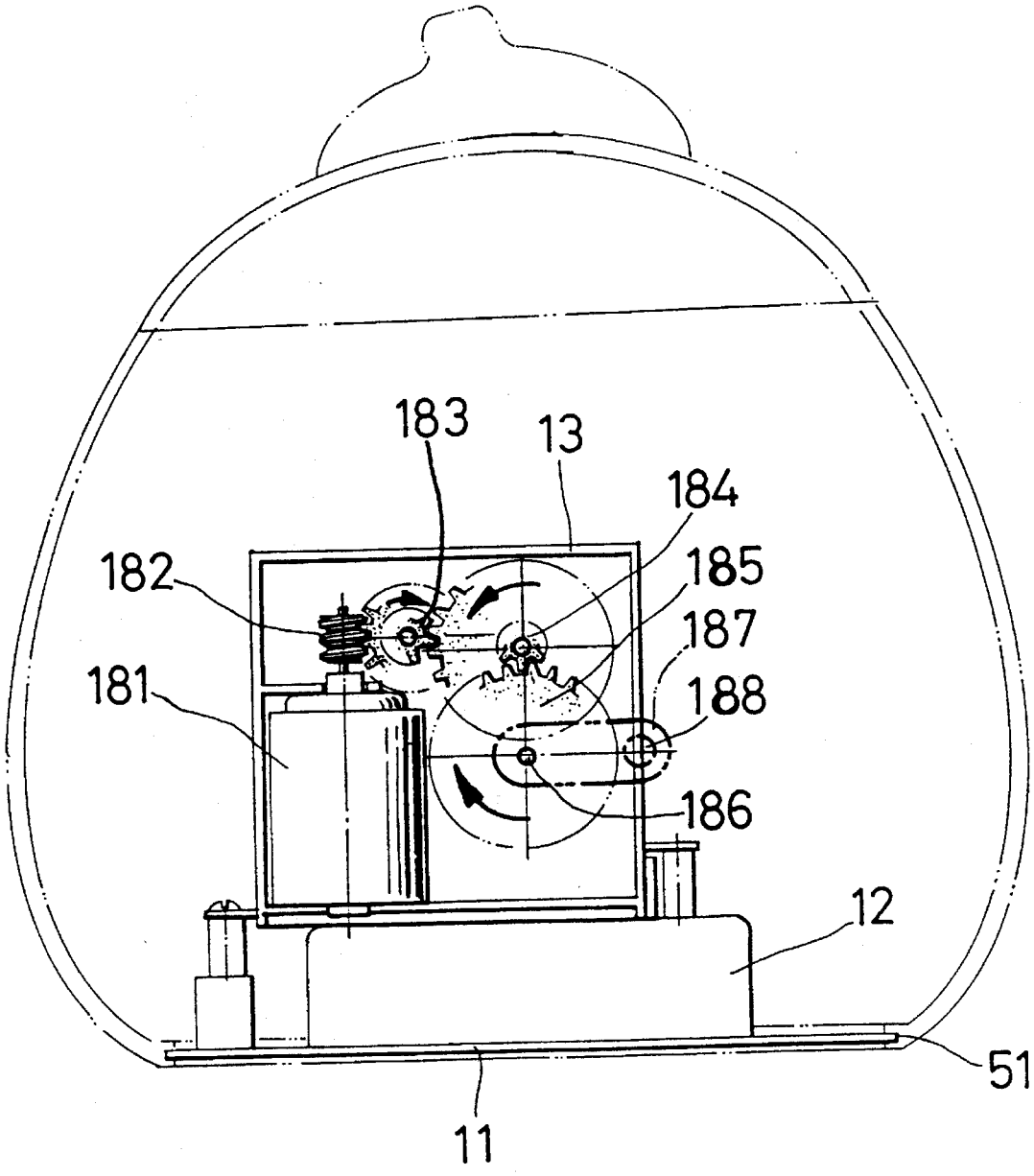
FIG. 3 is a cross sectional view taken along lines Z—Z of FIG. 2.

Referring to the drawings, and initially to FIGS. 1 to 3, a toy in accordance with the present invention comprises an outer housing, such as a pumpkin formed by two halves 4, 5, and a head or a face 21 of a figure concealed within the outer housing 4, 5 and elevated when required.

The toy comprises a driving mechanism 1 including a base 11, a casing 12 disposed on the base 11 for accommodating batteries therein, a gear box 13 disposed on the casing 12 and including a number of posts 132 extended therefrom, a hole 131 formed in each of the posts 132, an electric board 14, a speaker 15, a switch 16 and a receiver 17 disposed beside the casing 12, a transmission mechanism 18 disposed in the gear box 13 and including a motor 181, a worm gear 182 secured to the spindle of the motor 181 for driving a gear 183 which is rotatably supported in the gear box 13, the gear 183 driving another gear 184 which drives another gear 185, the supporting axle 186 of the gear 185 extends outward of the gear box 13, a lever 187 including one end fixed to the axle 186 and another end having a stub 188 secured thereon, such that the lever 187 can be rotated about the axle 186 by the motor 181.

A sliding element 2 includes a figure or a head 21 provided in the upper portion, one or more holes 22 are formed in the upper portion of the sliding element 2 for engaging with screws 221 so as to fix the sliding element 2 to a cap 6, the sliding element 2 includes a pair of parallel flanges 23 extended forward therefrom, and a transverse groove 24 and a vertical groove 25 formed in the sliding element 2, the stub 188 of the lever 187 is slidingly engaged in the transverse groove 24 of the sliding element 2. A plate 3 includes two side edges 31 fixed to the posts 132 of the gear box 13 by screws 312 which are engaged with the holes 311 of the plate 3, and a projection 32 engaged with the vertical groove 25 of the sliding element 2. The sliding element 2 is slidingly engaged in the plate 3 and is limited to move up and down by the engagement between the vertical groove 25 and the projection 32, and the sliding element 2 is caused to move up and down by the engagement between the transverse groove 24 and the stub 188 when the lever 187 is rotated by the motor 181.

The two halves of the outer housing 4, 5 each includes a number of stubs 43, 52 formed therein and each having a screw hole 431, 521 formed therein such that the two halves 4, 5 can be fixed together by bolts 53, each of the two halves includes a channel 42, 51 formed in the bottom of the inner peripheral portion thereof for engaging with the outer peripheral portion of the base 11 such that the base 11 can be solidly secured within the housing 4, 5, two light bulbs 41 are provided in the eye holes of the pumpkin head.

Figure 4:
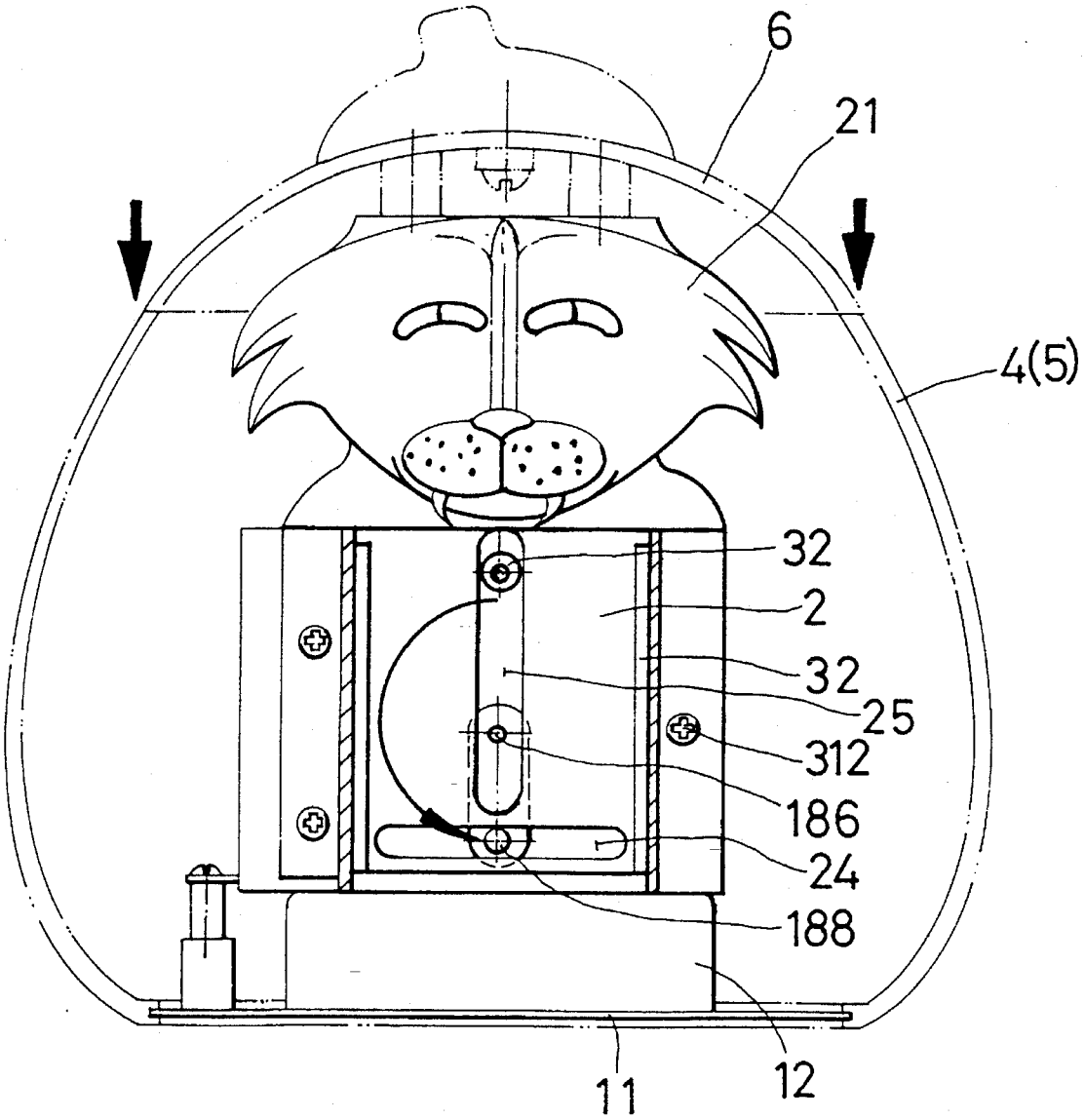
FIGS. 4 and 5 are schematic views illustrating the operations of the toy.
Figure 5:
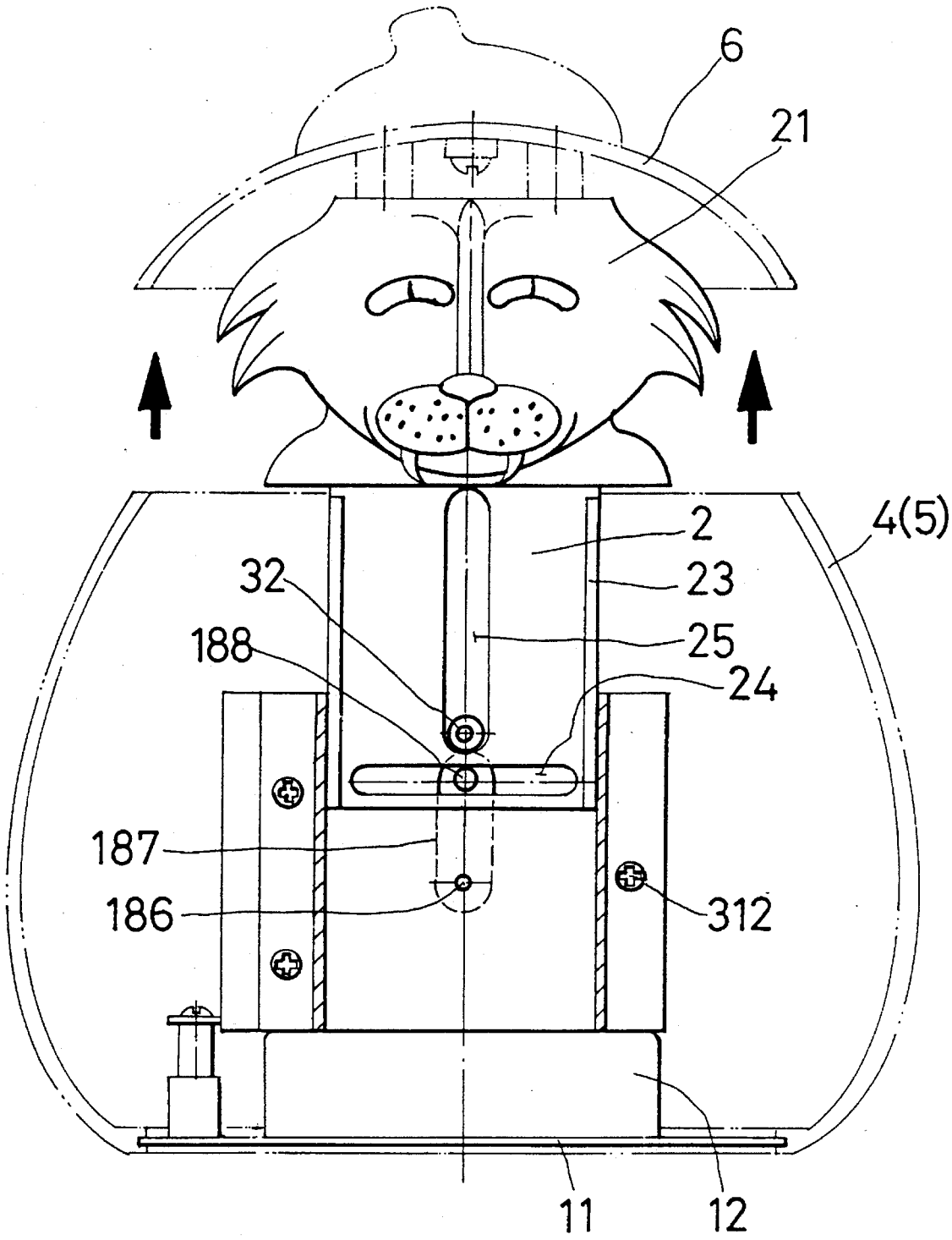

As best shown in FIGS. 2 and 3, the two halves 4, 5 of the housing and the cap 6 form an integral pumpkin head altogether, the head 21 of the figure can be concealed within the housing 4, 5 and the cap 6, however, as shown in FIGS. 4 and 5, when the lever 187 is rotated by the motor 181, the sliding element 2 and the head 21 are both elevated such that the head 21 is moved outward of the housing 4, 5 and can be seen from outside of the housing 4, 5.

It is preferable that the receiver 17 may receive a sound as a signal which is transmitted to the electric board 14 so as to operate the motor and the speaker, in addition, when the head 21 is elevated, it is preferable that the speaker utter a sound and the light bulbs 41 are energized when the head 21 is elevated in order to frighten other people.

Figure 6:
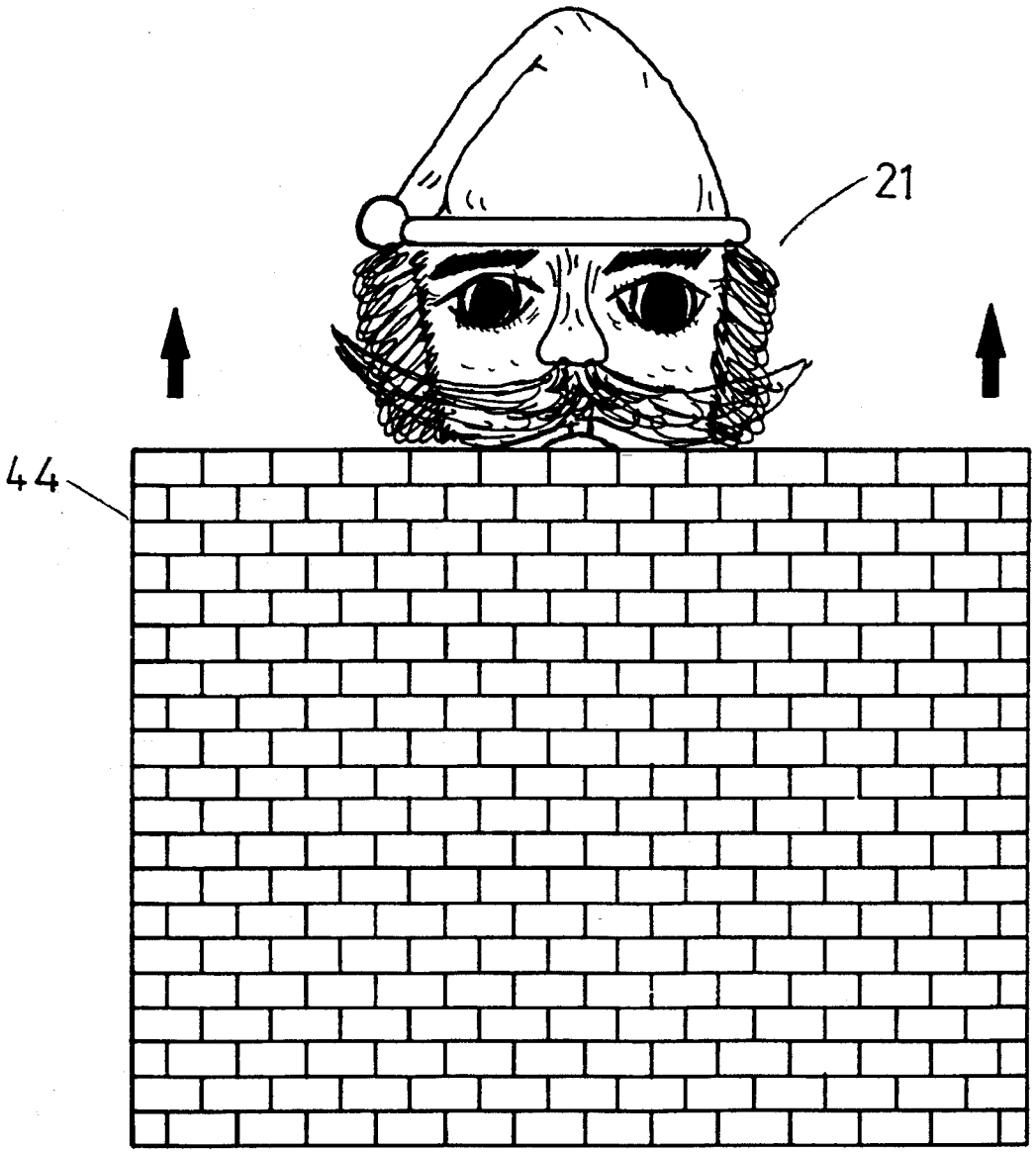
FIG. 6 is a schematic view illustrating another application of the present invention.

As shown in FIG. 6, instead of the pumpkin shaped housing, a wall member 44 may be provided for hiding the head 21, the head 21 may be moved upward beyond the wall member 44 suddenly in order to frighten people.

Accordingly, the toy in accordance with the present invention includes a head that can be concealed and elevated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A toy comprising a housing including an upper portion having a cap provided thereon and including a hollow interior having a bottom portion, a base secured in said bottom portion, a figure secured to said cap and concealed in said housing, and means for elevating said figure and said cap in order to move said figure out of said housing, said elevating means including a gear box disposed on said base, an axle rotatably supported in said gear box and extended outward of said gear box, a lever including a first end fixed to said axle and a second end having a stub secured thereto, means for rotating said axle, a plate fixed to said gear box and including a projection extended toward said gear box, a sliding element slidingly disposed between said plate and said gear box and including a vertical groove and a transverse groove formed therein for engaging with said projection and said stub respectively, said figure being fixed to said sliding element, said sliding element being limited to move up and down by engagement between said projection and said vertical groove, and said sliding element being moved up and down by engagement between said stub and said transverse groove when said lever is rotated.

2. A toy according to claim 1, wherein said rotating means includes a motor disposed in said gear box and including a spindle, and a gearing engaged between said spindle and said axle so as to transmit a rotational movement of said spindle to said axle, whereby, said axle is rotated by said motor when said motor is energized.

* * * * *